US005829641A

United States Patent [19]

Bartsch et al.

[11] Patent Number: 5,829,641

[45] Date of Patent: Nov. 3, 1998

[54] DISPENSING PUMP LOCK

[75] Inventors: Eric R. Bartsch; Michael J. D'Amelio, both of Cincinnati, Ohio

[73] Assignee: The Procter & Gamble Company, Cincinnati, Ohio

[21] Appl. No.: 732,824

[22] Filed: Oct. 15, 1996

[51] Int. Cl.[6] ..... B67D 5/33

[52] U.S. Cl. ..... 222/153.13

[58] Field of Search ..... 222/182, 321.8, 222/384, 383.1, 153.13, 49, 402.11

[56] References Cited

U.S. PATENT DOCUMENTS

| | | | |
|---|---|---|---|
| 2,731,166 | 1/1956 | Raphael | 215/52 |
| 2,947,431 | 8/1960 | Haynes | 215/9 |
| 2,994,447 | 8/1961 | Haynes | 215/9 |
| 3,033,406 | 5/1962 | Sauber | 215/9 |
| 3,059,801 | 10/1962 | Dragon | 215/98 |
| 3,249,260 | 5/1966 | Goldberg | 222/402.11 |
| 3,311,247 | 3/1967 | Rigor | 215/9 |
| 3,313,441 | 4/1967 | Fadden | 215/76 |
| 3,383,885 | 5/1968 | Epstein | 70/167 |
| 3,405,828 | 10/1968 | Pierre | 215/9 |
| 3,407,954 | 10/1968 | Millis | 215/9 |
| 3,422,996 | 1/1969 | Lipman | 222/384 |
| 3,445,021 | 5/1969 | Johnson | 215/9 |
| 3,587,896 | 6/1971 | Graff | 215/9 |
| 3,684,117 | 8/1972 | Leopoldi et al. | 215/9 |
| 3,703,974 | 11/1972 | Boxer et al. | 215/9 |
| 3,822,027 | 7/1974 | Cherba | 215/9 |
| 3,978,699 | 9/1976 | Kay 'Triniak | 70/232 |
| 4,011,829 | 3/1977 | Wachsmann et al. | 116/121 |
| 4,011,970 | 3/1977 | Crowle et al. | 222/321 |
| 4,162,746 | 7/1979 | Anderson et al. | 222/153 |
| 4,345,691 | 8/1982 | Burke | 215/216 |
| 4,420,096 | 12/1983 | Kirk, Jr. | 222/44 |
| 4,434,915 | 3/1984 | Kirk, Jr. | 222/153 |
| 4,496,082 | 1/1985 | Corsette | 222/153 |
| 4,735,346 | 4/1988 | Stoody | 222/153 |
| 4,773,567 | 9/1988 | Stoody | 222/402.11 |
| 4,809,888 | 3/1989 | Suck et al. | 222/402.11 |
| 4,867,347 | 9/1989 | Wass et al. | 222/153 |
| 4,991,746 | 2/1991 | Schultz | 222/321 |
| 5,050,779 | 9/1991 | Knickerbocker | 222/153 |
| 5,161,716 | 11/1992 | Knickerbocker | 222/153 |
| 5,358,129 | 10/1994 | Watts | 215/206 |
| 5,366,118 | 11/1994 | Ciammitti et al. | 222/153 |
| 5,405,057 | 4/1995 | Moore | 222/153.14 |
| 5,458,263 | 10/1995 | Ciammitti et al. | 222/153.1 |
| 5,476,181 | 12/1995 | Seidler | 215/223 |
| 5,520,305 | 5/1996 | Pierson | 222/182 |

FOREIGN PATENT DOCUMENTS 1 907 891 9/1969 Germany .

*Primary Examiner*—Philippe Derakshani
*Attorney, Agent, or Firm*—William Scott Andes

[57] ABSTRACT

Disclosed is a locking assembly for use with a pump-type dispenser to dispense material from a container. The assembly includes an actuator including at least one tooth integral to the actuator and a support ring which slidably engages the actuator. The support ring has at least one integral circumferential ridge with at least one ridge slot. The ridge is for limiting movement of the actuator until the tooth is properly aligned with the ridge slot, thereby allowing movement of the actuator and dispensing of product from the container. Alignment of the ridge slot and tooth may be achieved by rotating the actuator until an actuator position indicator on the actuator is aligned with an unlocking indicator on the support ring.

21 Claims, 5 Drawing Sheets

DISPENSING PUMP LOCK

BACKGROUND OF THE INVENTION

1. Field of the Invention

The invention relates to child resistant locks for product containers. More particularly, the invention relates to child resistant locks designed for use with pump type dispensers.

2. Description of the Prior Art

Pump dispensers are conveniently used by consumers to draw fluid materials from within containers. These dispensers apply pressure to draw the material from within the container and force the material out of an outlet nozzle for use by the consumer. The controlled pumping mechanisms provided by these pump dispensers permits consumers to dispense fluids, and other materials, in a convenient, controlled manner.

Unfortunately, however, these pump type dispensers are often used to dispense materials that can be harmful to human beings, animals, and surrounding structures. As such, it is desirable to provide these pump type dispensers with locking assemblies to prevent unwanted pumping of the pump dispenser, particularly, to prevent unwanted pumping by children. The structures of these pump type dispensers make it difficult to incorporate effective locking assemblies capable of preventing a child from actuating the pump dispenser, while readily permitting an adult to pump material from the dispenser after the locking assembly has been disabled.

After reviewing prior pump dispensers, it is apparent that a need exists for a pump dispenser which incorporates a locking assembly to effectively prevent unwanted pumping of material therefrom, while permitting a user to conveniently disable the locking assembly to permit pumping of materials from the pump dispenser. The present invention provides a convenient, reliable and inexpensive child resistant locking assembly for use with pump dispensers, which overcomes the limitations of prior pump dispensers. Additionally, because the present locking assembly relies on coordination rather than force to be opened, it is ideal for use by elderly or arthritic persons.

SUMMARY OF THE INVENTION

It is, therefore, an object of the present invention to provide a child resistant locking assembly for use with a pump type dispenser to prevent unwanted dispensing of material from a container. The assembly includes an actuator having at least one integral tooth, and a locking mechanism comprising at least one circumferential ridge integral to a support ring. The actuator slidably engages the support ring. The circumferential ridge has a ridge slot which allows the tooth to pass by the ridge when the actuator is properly aligned with the support ring. The ridge acts as an obstruction to the tooth for limiting movement of the actuator until the locking mechanism has been disengaged. Disengagement is aided by an actuator positioning indicator on the actuator and an unlocking indicator on the support ring or container, which when aligned, enable the tooth to pass through the ridge slot, thereby allowing actuation of the pump and dispensing of product.

An alternative embodiment includes two circumferential ridges, each ridge having a ridge slot, the ridge slots being located at different circumferential positions around the support ring. At least one by-pass member is included which connects the two circumferential ridges and is configured so that when the tooth is in contact with the lower ridge, it may be moved toward the lower slot if the actuator is rotated in a first rotational direction, but if the actuator is moved in an opposite rotational direction away from the lower slot, the tooth will ride up the by-pass and once again be in contact with the upper ridge. Additionally, a direction control member may be included which allows the actuator to be rotated in a first rotational direction so that the tooth may pass through the upper ridge slot, but prevents the tooth from passing through the upper ridge slot if the actuator is rotated in an opposite rotational direction. Finally, the lower ridge may be configured so as to only extend between two by-pass members, thereby eliminating superfluous portions of the lower ridge, which allows the actuator to be pulled up to a locked position more easily.

Objects of the invention include providing a child resistant lock for pump type dispensers, providing a lock that is easy and inexpensive to manufacture, providing a lock that has a minimum of required parts, and providing a lock that is easy for adults and elderly persons to open while remaining difficult for children to open. Other objects and advantages of the present invention will become apparent from the following detailed description when viewed in conjunction with the accompanying drawings, which set forth and include certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
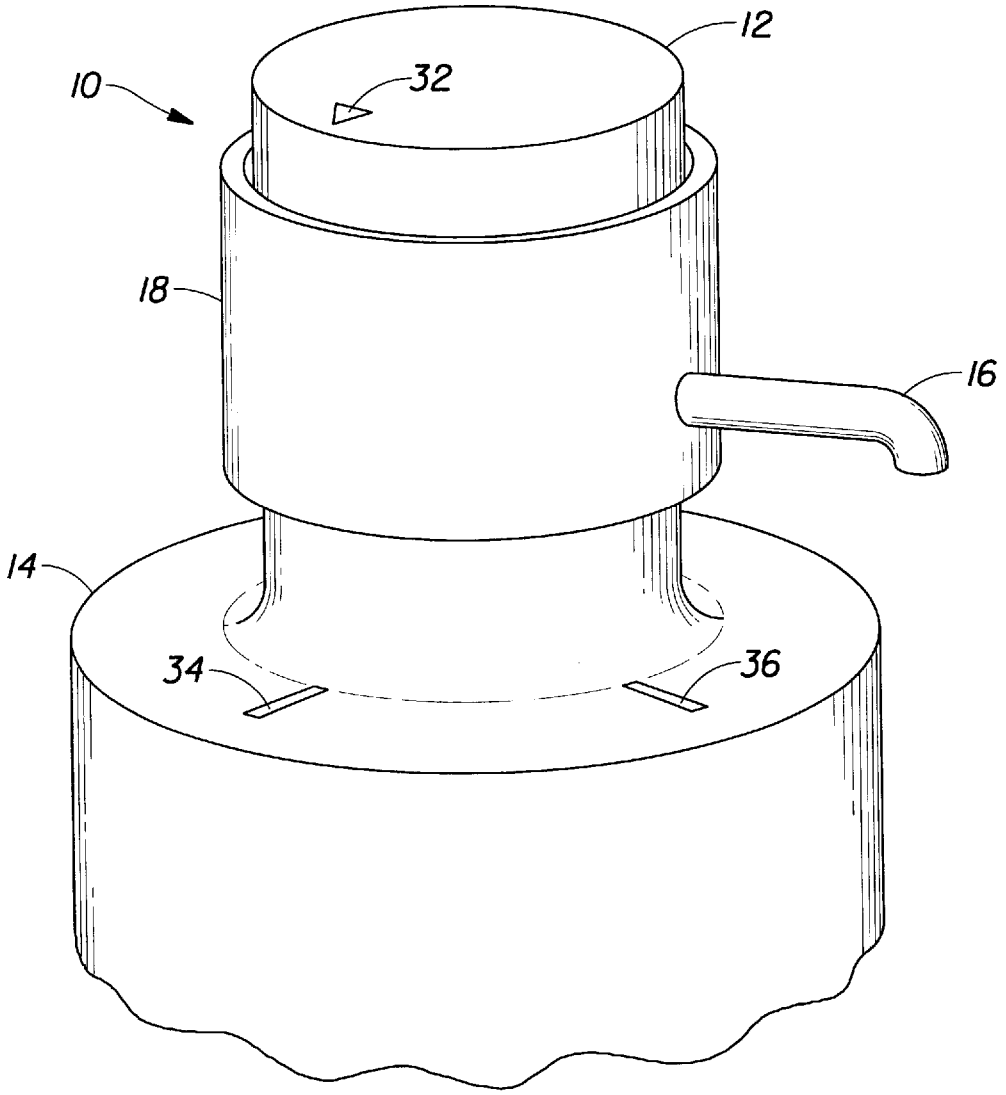
FIG. 1 is a perspective view of a dispensing pump incorporating the present child-resistant lock.

With reference to FIG. 1, a pump dispenser 10 including the present locking assembly is disclosed. As with conventional pump dispensers, the present invention is provided with an actuator 12 which is pushed downwardly to cause the flow of materials from a container 14. The pumped material exits through an outlet dispensing nozzle 16 mounted on an exterior support ring 18. The actuator 12 moves a pump mechanism (not shown) which draws material from within the container 14 and causes the material to flow out of the outlet nozzle 16. A variety of pump mechanisms are well known and the actual pump mechanism may vary. However, it should be understood that the up and down movement of the actuator 12 creates pressure causing the contents of the container to flow through, and out of, the pump dispenser 10. Examples of pump mechanisms are found in U.S. Pat. Nos. 4,867,347 to Wass et al. and 4,991,746 to Schultz, which are incorporated herein by reference.

Figure 2:
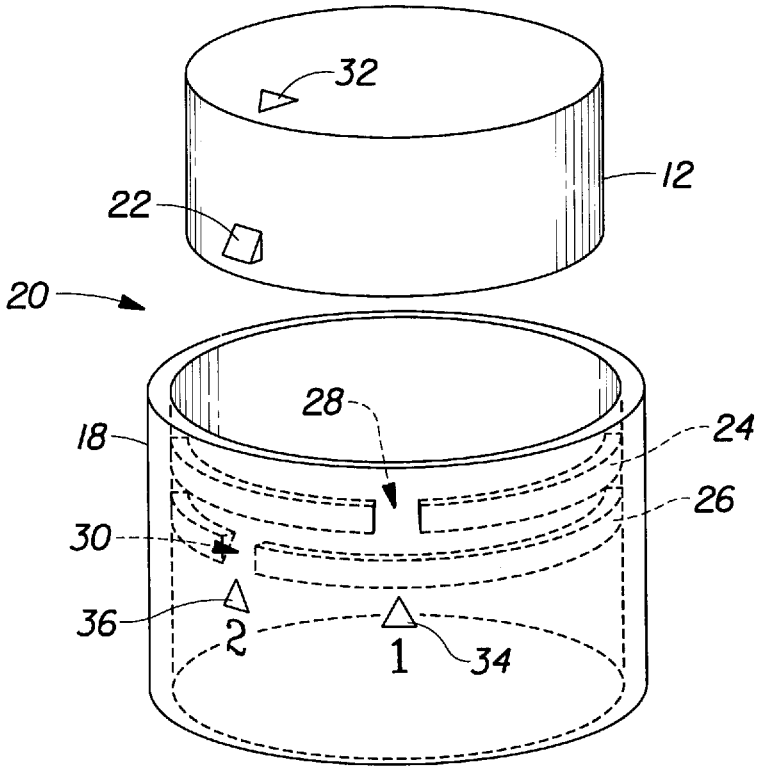
FIG. 2 is a perspective view showing the actuator disengaged from the support ring.
Figure 3:
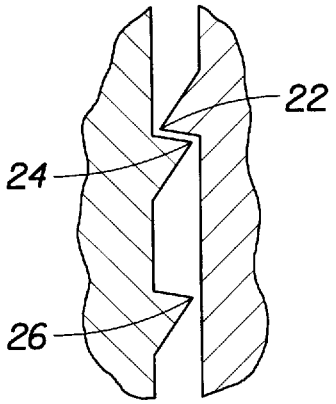
FIG. 3 is a sectional view of the interaction between the actuator tooth and the circumferential ridge of the support ring in the locked position.

With this in mind, and referring to FIG. 2, the present invention provides a lock assembly 20 which prevents children from moving actuator 12 up and down (that is, pumping) and causing the contents of container 14 to flow through pump dispenser 10. With reference to FIGS. 2 and 3, the present locking assembly 20 includes an actuator 12 for drawing materials from container 14 to dispense the materials from container 14. Actuator 12 includes at least one integral tooth 22. In accordance with the preferred embodiment of the present invention, tooth 22 is positioned on actuator 12 so that it engages upper and lower circumferential ridges 24 and 26 when in the non-dispensing position, although tooth 22 could be positioned on actuator 12 in a variety of locations without departing from the spirit of the invention. Tooth 22 should be placed low enough on actuator 12 so that no dispensing at all can take place when actuator 12 is pushed down and tooth 22 contacts either upper ridge 24 or lower ridge 26.

Ridges 24 and 26 are integral to support ring 18, and include upper and lower ridge slots 28 and 30 respectively. Actuator 12 must be manipulated or rotated so as to first line tooth 22 up with upper ridge slot 28, allowing tooth 22 to pass by upper ridge 24. The actuator must then be manipulated or rotated so as to line tooth 22 up with lower ridge slot 30, allowing tooth 22 to pass by lower ridge 26. Only then can the actuator be fully depressed, thereby creating pressure to dispense product from the container.

FIG. 3 shows the configurations of tooth 22 and ridges 24 and 26. The horizontal faces of tooth 22 and ridges 24 and 26 engage each other when actuator 12 is depressed and in the locked position so as to prevent actuation and dispensing. Unlocking is accomplished by passing tooth 22 through each of ridge slots 28 and 30, which requires coordination and control typically not possessed by children. To relock actuator 12 from the dispensing position, one need only pull up on actuator 12; the angled surfaces on tooth 22 and ridges 24 and 26 allow tooth 22 to pass over ridges 24 and 26 without need to run tooth 22 back through slots 28 and 30. Tooth 22 and ridges 24 and 26 should be configured and dimensioned to take advantage of the flexibility of the plastic or other material used; i.e., they should be dimensioned so that proper operation of lock assembly 20 can take place, preferably without causing any permanent deformation of tooth 22 and ridges 24 and 26.

Referring back to FIG. 1, the user would manipulate tooth 22 through slots 28 and 30 by use of actuator position indicator 32 and unlocking indicators 34 and 36. The indicators are placed such that lining up of indicator 32 with indicator 34 lines tooth 22 up with slot 28, thereby allowing tooth 22 to drop down and contact ridge 26. Subsequent alignment of indicator 32 with indicator 36 lines tooth 22 up with slot 30, thereby allowing tooth 22 to drop down past ridge 26 to a position where actuator 12 can be fully depressed and product can be dispensed.

Figure 4A:
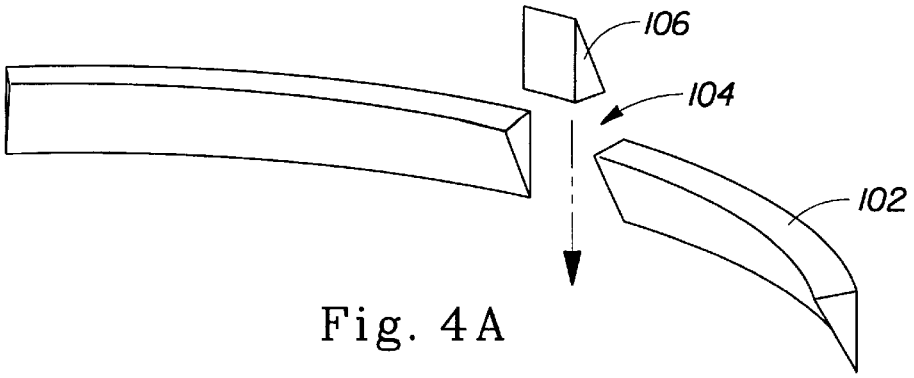
FIGS. 4*a,* 4*b,* and 4*c* depict three different embodiments of circumferential ridges and ridge slots of the present invention.
Figure 4B:
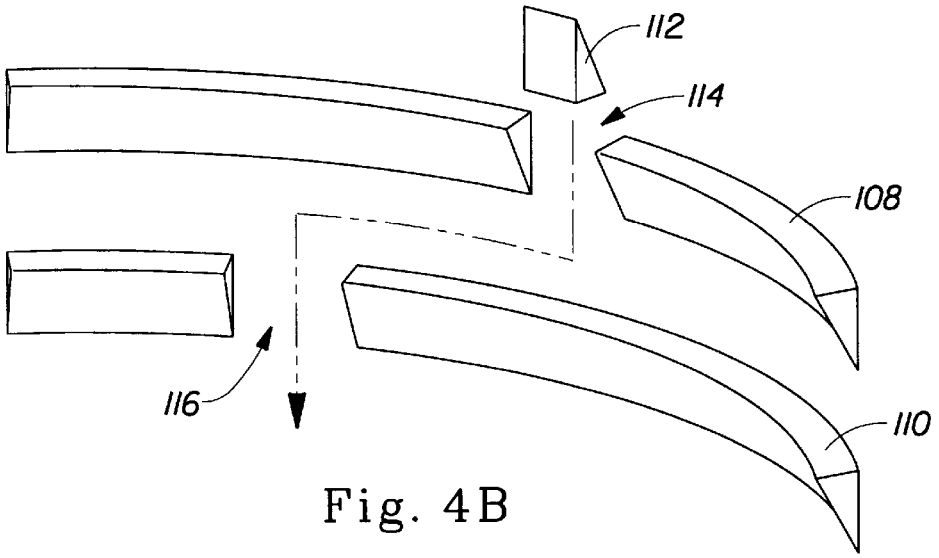
Figure 4C:
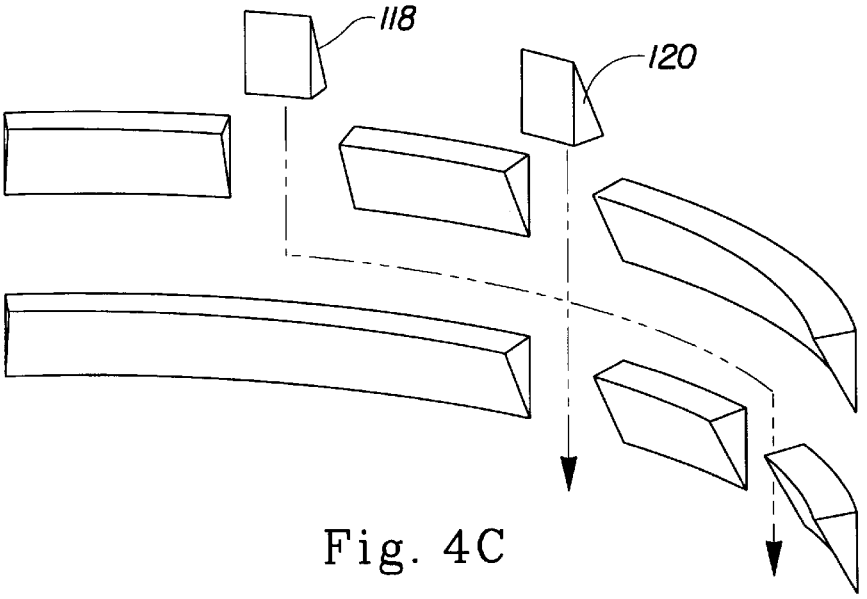

Referring now to FIGS. 4*a,* 4*b,* and 4*c,* various embodiments of the present invention will now be described. The simplest form of this invention is use of one ridge 102 with one ridge slot 104. One tooth 106 is provided on integral actuator 12. Tooth 106 interferes with ridge 102 and prevents dispensing of product until tooth 106 is aligned with slot 104 and bypasses ridge 102. The user lines tooth 106 up with slot 104 through indicators as discussed above. FIG. 4*b* shows the embodiment described above, which uses two ridges 108 and 110. Because tooth 112 must be manipulated through two staggered slots 114 and 116, this embodiment is more difficult for a child to open than that of FIG. 4*a*. The slots 114 and 116 can be located anywhere along their respective ridges. Again, the user lines up tooth 112 with slots 114 and 116 through indicators as discussed above, and unlocking (dispensing) may take place so long as the indicator positioning is properly coordinated with the positions of ridge slots 114 and 116 and tooth 112. FIG. 4*c* depicts an embodiment that uses two teeth 118 and 120, both integral to the actuator. This embodiment works similarly to that of FIG. 4*b*, however two slots are provided in each ridge to accommodate the two teeth.

Figure 5:
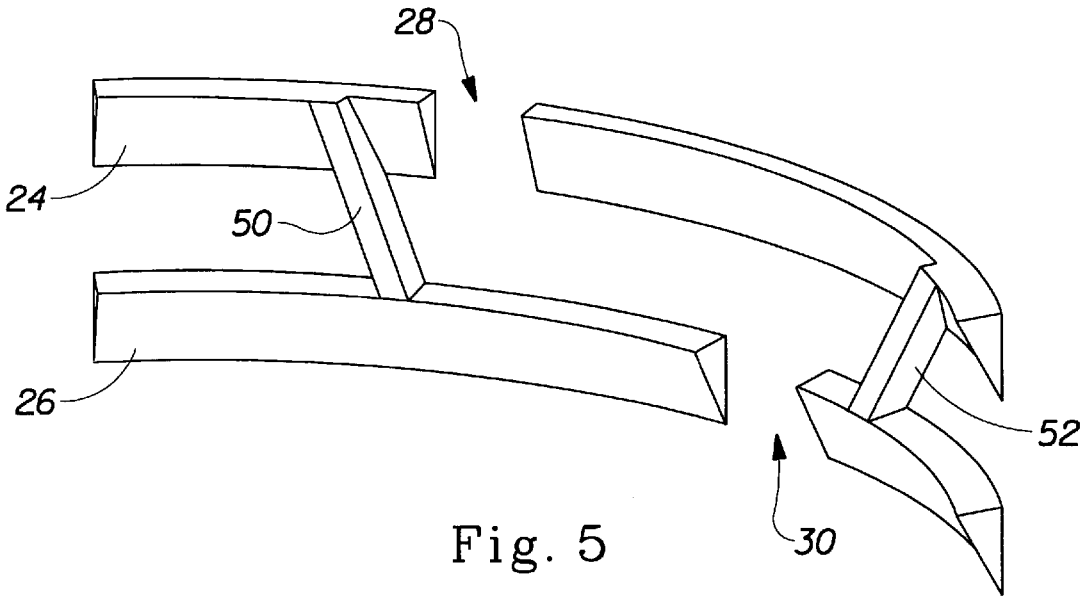
FIG. 5 depicts an alternative embodiment of the circumferential ridge of the present invention.

Referring now to FIG. 5, two ridges 24 and 26 are shown, having ridge slots 28 and 30 respectively. Included in this embodiment are by-pass members 50 and 52 which connect ridges 24 and 26 and are angled outwardly from ridge 26 and ridge slot 30. As can be seen in FIG. 5, the intersection of by-pass members 50 and 52 with upper ridge 24 is configured such that if tooth 22 is in contact with lower ridge 26 but is turned in a direction away from slot 30, tooth 22 may ride up the by-pass surface past the top of upper ridge 24 and return once again to its fully upward and locked position.

Figure 6:
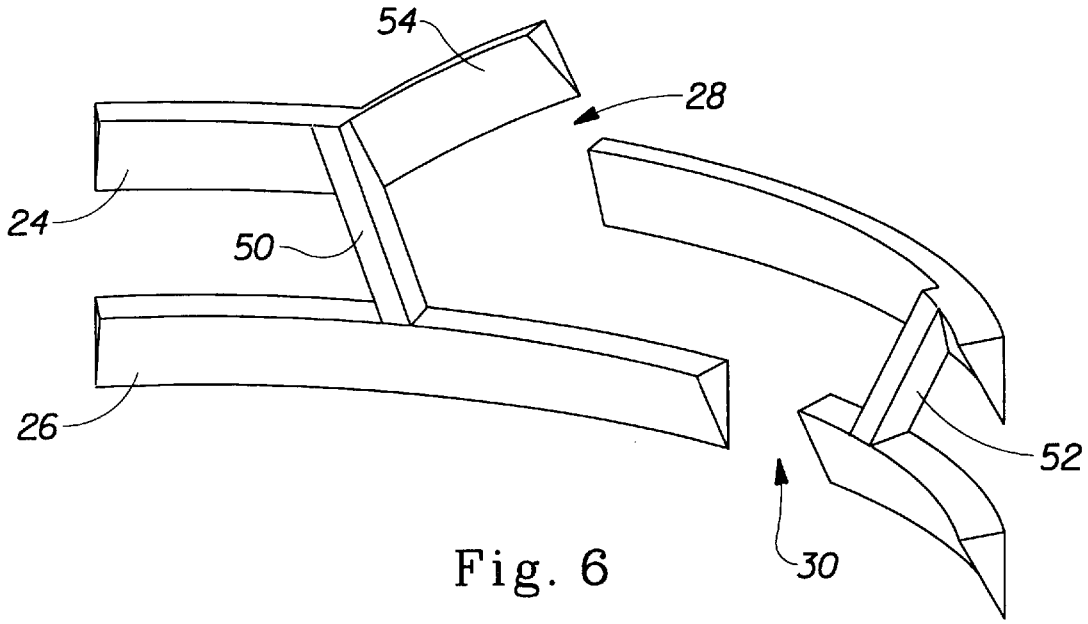
FIG. 6 depicts yet another alternative embodiment of the circumferential ridge of the present invention.
Figure 7:
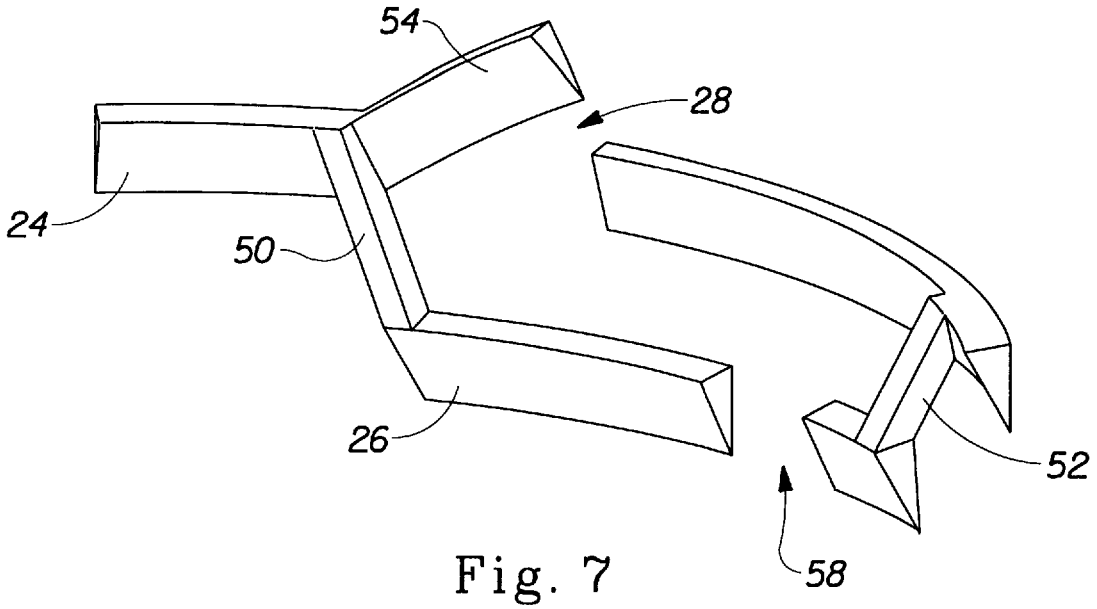
FIG. 7 depicts yet another alternative embodiment of the circumferential ridge of the present invention.

Referring now to FIG. 6, directional control member 54 may be included which is configured to allow tooth 22 to pass through upper slot 28 when actuator 12 is rotated in one direction (counterclockwise in FIG. 6) and to prevent tooth 22 from passing through upper slot 28 when actuator 12 is rotated in an opposite direction (clockwise in FIG. 6), in which case tooth 22 would jump over and past slot 28. As shown in FIG. 7, limiting the extent of lower ridge 26 to an area between by-passes 50 and 52 eliminates superfluous portions of ridge 26, thereby allowing actuator 12 to be pulled up past ridges 24 and 26 more easily when the actuator is to be moved to the fully locked position.

While the preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A locking assembly for use with a pump-type dispenser, to dispense material from a container, comprising:

an actuator including an integral obstruction;

a support ring slidably engaged with the actuator; and a locking mechanism integral to the support ring for limiting movement of the actuator until the obstruction is properly aligned with the locking mechanism, wherein alignment is achieved by rotating the actuator to a first predetermined position, partially depressing the actuator, then rotating the actuator to a second predetermined position where the actuator may be fully depressed for dispensing.

2. The locking assembly according to claim 1, wherein the integral obstruction is at least one tooth.

3. The locking assembly according to claim 2, wherein the locking mechanism includes at least one circumferential ridge extending at least partially around the support ring.

4. The locking assembly according to claim 3, wherein the at least one circumferential ridge includes a ridge slot at a predetermined position along the circumferential ridge.

5. The locking assembly according to claim 1, wherein the actuator includes an actuator position indicator, and the support ring includes an unlocking indicator, alignment of the position indicator with the unlocking indicator indicating when the obstruction is properly aligned with the locking mechanism for disengagement of the locking assembly.

6. The locking assembly according to claim 4, wherein the actuator includes an actuator position indicator, and the support ring includes an unlocking indicator, alignment of the position indicator with the unlocking indicator indicating when the tooth is properly aligned with the ridge slot for disengagement of the locking assembly.

7. The locking assembly according to claim 6, wherein the tooth and ridge are each configured so that the tooth slides over the ridge in a first direction, and the ridge obstructs movement of the tooth in a second direction.

8. A locking assembly for use with a pump-type dispenser, to dispense material from a container, comprising:

an actuator including an integral obstruction;

a support ring slidably engaged with the actuator; and a locking mechanism integral to the support ring for limiting movement of the actuator until the obstruction is properly aligned with the locking mechanism, wherein alignment is achieved by rotating the actuator to a first predetermined position, wherein the integral obstruction is at least one tooth, wherein the locking mechanism includes at least one circumferential ridge extending at least partially around the support ring, wherein the at least one circumferential ridge includes a ridge slot at a predetermined position along the circumferential ridge, wherein the actuator includes an actuator position indicator, and the support ring includes an unlocking indicator, alignment of the position indicator with the unlocking indicator indicating when the tooth is properly aligned with the ridge slot for disengagement of the locking assembly, wherein the tooth and ridge are each configured so that the tooth slides over the ridge in a first direction, and the ridge obstructs movement of the tooth in a second direction, wherein the locking mechanism includes a first circumferential ridge having a first ridge slot, and a second circumferential ridge having a second ridge slot, the first ridge slot being positioned at a different circumferential position on the first ridge than the circumferential position of the second ridge slot on the second ridge.

9. A pump dispenser including a locking assembly, comprising:

an actuator for drawing materials from a container to dispense the materials from the container, the actuator including an integral obstruction;

a support ring slidably engaged with the actuator for relative reciprocating movement in an axial direction; and a locking mechanism integral to the support ring for limiting axial movement of the actuator until the obstruction is properly aligned with the locking mechanism, wherein alignment is achieved by rotating the actuator to a first predetermined position, wherein the obstruction and locking mechanism are each configured so that the obstruction slides over the locking mechanism in a first axial direction and, the locking mechanism obstructs movement of the obstruction in a second axial direction thereby preventing axial movement of the actuator to dispense materials from the container.

10. The pump dispenser according to claim 9, wherein the integral obstruction is at least one tooth.

11. The pump dispenser according to claim 10, wherein the locking mechanism includes at least one circumferential ridge extending at least partially around the support ring.

12. The pump dispenser according to claim 11, wherein the at least one circumferential ridge includes a ridge slot at a predetermined position along the circumferential ridge.

13. The pump dispenser according to claim 9, wherein the actuator includes an actuator position indicator, and the support ring includes an unlocking indicator, alignment of the position indicator with the unlocking indicator indicating when the obstruction is properly aligned with the locking mechanism for disengagement of the locking assembly.

14. The pump dispenser according to claim 12, wherein the actuator includes an actuator position indicator, and the support ring includes an unlocking indicator, alignment of the position indicator with the unlocking indicator indicating when the tooth is properly aligned with the ridge slot for disengagement of the locking assembly.

15. A pump dispenser including a locking assembly, comprising:

an actuator for drawing materials from a container to dispense the materials from the container, the actuator including an integral obstruction;

a support ring slidably engaged with the actuator; and a locking mechanism integral to the support ring for limiting movement of the actuator until the obstruction is properly aligned with the locking mechanism, wherein alignment is achieved by rotating the actuator to a first predetermined position, wherein the obstruction and locking mechanism are each configured so that the obstruction slides over the locking mechanism in a first direction and, the locking mechanism obstructs movement of the obstruction in a second direction thereby preventing movement of the actuator to dispense materials from the container, wherein the integral obstruction is at least one tooth, wherein the locking mechanism includes at least one circumferential ridge extending at least partially around the support ring, wherein the at least one circumferential ridge includes a ridge slot at a predetermined position along the circumferential ridge, wherein the actuator includes an actuator position indicator, and the support ring includes an unlocking indicator, alignment of the position indicator with the unlocking indicator indicating when the tooth is properly aligned with the ridge slot for disengagement of the locking assembly, wherein the locking mechanism includes a first circumferential ridge having a first ridge slot, and a second circumferential ridge having a second ridge slot, the first ridge slot being positioned at a different circumferential position on the first ridge than the circumferential position of the second ridge slot on the second ridge.

16. A container, comprising:

a body for storing materials therein, the body having a pump dispenser secured thereto;

the pump dispenser includes;

an actuator including at least one integral tooth;

a support ring slidably engaged with the actuator for relative reciprocating movement in an axial direction; and at least one circumferential ridge extending at least partially around the support ring and being integral to the support ring for limiting axial movement of the actuator until the tooth is properly aligned with the ridge, wherein alignment is achieved by rotating the actuator to a first predetermined position, wherein the tooth and ridge are each configured so that the tooth slides over the ridge in a first axial direction and, the ridge obstructs movement of the tooth in a second axial direction thereby preventing axial movement of the actuator to dispense materials from the container.

17. The container according to claim 16, wherein the at least one circumferential ridge includes a ridge slot at a predetermined position along the circumferential ridge.

18. The container according to claim 17, wherein the actuator includes an actuator position indicator, and the support ring includes an unlocking indicator, alignment of the position indicator with the unlocking indicator indicating when the tooth is properly aligned with the ridge slot for disengagement of the locking assembly.

19. A container, comprising:

a body for storing materials therein, the body having a pump dispenser secured thereto;

the pump dispenser includes:

an actuator including at least one integral tooth;

a support ring slidably engaged with the actuator; and at least one circumferential ridge extending at least partially around the support ring and being integral to the support ring for limiting movement of the actuator until the tooth is properly aligned with the ridge, wherein alignment is achieved by rotating the actuator to a first predetermined position, wherein the tooth and ridge are each configured so that the tooth slides over the ridge in a first direction and, the ridge obstructs movement of the tooth in a second direction thereby preventing movement of the actuator to dispense materials from the container, wherein the at least one circumferential ridge includes a ridge slot at a predetermined position along the circumferential ridge, further comprising an upper circumferential ridge and a lower circumferential ridge, each ridge having a ridge slot, the ridge slots being at different circumferential position on the support ring such that rotating the actuator to the first predetermined position allows the tooth to pass through the upper ridge slot and come into contact with the lower ridge, and subsequently rotating the actuator to a second predetermined position allows the tooth to pass through the lower ridge slot to allow dispensing of materials from the container, there being at least one by-pass member connecting the upper and lower ridges and configured such that when the tooth is in contact with the lower ridge and the actuator is turned in a direction away from the second predetermined position, the tooth rides up the by-pass member and returns to a position in which the upper ridge obstructs movement of the tooth, thereby preventing movement of the actuator to dispense materials from the container.

20. The container according to claim 19, further comprising a directional control member which allows the actuator to be rotated to the first predetermined position in a first rotational direction, but prevents the actuator from being rotated to the first predetermined position in an opposite rotational direction.

21. The container according to claim 20, wherein the lower ridge extends between two by-pass members, each by-pass member being angled upwardly and away from the lower ridge slot.

* * * * *